US010018440B2

(12) United States Patent
Shults et al.

(10) Patent No.: US 10,018,440 B2
(45) Date of Patent: Jul. 10, 2018

(54) SMALL CALIBER SUPPRESSOR

(71) Applicant: SilencerCo, LLC, West Valley City, UT (US)

(72) Inventors: Jonathon Shults, Sandy, UT (US); Harrison Holden, Sandy, UT (US); Casey Brandol, West Jordan, UT (US)

(73) Assignee: SilencerCo, LLC, West Valley City, UT (US)

( * ) Notice: Subject to any disclaimer, the term of this patent is extended or adjusted under 35 U.S.C. 154(b) by 0 days.

(21) Appl. No.: 15/251,077

(22) Filed: Aug. 30, 2016

(65) Prior Publication Data

US 2017/0074613 A1 Mar. 16, 2017

Related U.S. Application Data

(60) Provisional application No. 62/216,420, filed on Sep. 10, 2015.

(51) Int. Cl.
*F41A 21/30* (2006.01)

(52) U.S. Cl.
CPC ..... *F41A 21/30* (2013.01)

(58) Field of Classification Search
CPC ..... F41A 21/30
See application file for complete search history.

(56) References Cited

U.S. PATENT DOCUMENTS 825,010 A * 7/1906 Snow ..... F01N 1/08 181/264
918,784 A 4/1909 Snow
959,400 A * 5/1910 Stinson ..... F41A 21/30 181/223
1,006,595 A 10/1911 Red
1,017,003 A 2/1912 Kenney
1,111,202 A 9/1914 Westfall
1,341,363 A 5/1920 Fiala
1,394,490 A 10/1921 Giles
1,482,805 A 2/1924 Maxim
1,605,864 A 11/1926 Steinegger
1,747,876 A 2/1930 Metzgar
1,874,326 A 8/1932 Mason
2,451,514 A 10/1948 Sieg
2,780,962 A 2/1957 Ressler et al.
2,852,983 A 9/1958 Netzer
2,870,679 A 1/1959 Collins
2,900,875 A 8/1959 Fergus et al.
(Continued)

FOREIGN PATENT DOCUMENTS

EP 2977708 A1 1/2016
FR 2719937 A1 * 11/1995 ..... F41A 21/30
WO 9407103 A1 3/1994

OTHER PUBLICATIONS

Machine Translation of FR 2719937 to Louvat, European Patent Office.*

*Primary Examiner* — Stephen Johnson
*Assistant Examiner* — Joshua T Semick

(57) ABSTRACT

A sound suppressor for a firearm includes a plurality of segments attached end to end to form a container having an entrance orifice and an exit orifices defining a firing axis. Baffles are positioned in some of the segments. The baffles have a plate from which a truncated cone projects. The cone defines an opening aligned with the firing axis. The opening is offset from the geometric center of the plates.

16 Claims, 4 Drawing Sheets

(56) References Cited

U.S. PATENT DOCUMENTS

| | | | | |
|---|---|---|---|---|
| 4,291,610 | A | 9/1981 | Waiser | |
| 4,576,083 | A | 3/1986 | Seberger, Jr. | |
| 4,584,924 | A | 4/1986 | Taguchi | |
| 4,588,043 | A | 5/1986 | Finn | |
| 4,757,741 | A | 7/1988 | Brothers | |
| 4,893,544 | A | 1/1990 | Hawley et al. | |
| 4,907,488 | A | 3/1990 | Seberger | |
| 5,110,145 | A | 5/1992 | Stewart | |
| 5,164,535 | A | 11/1992 | Leasure | |
| 5,192,219 | A | 3/1993 | Fowler et al. | |
| 5,215,336 | A | 6/1993 | Worthing | |
| 5,259,690 | A | 11/1993 | Legge | |
| 5,425,299 | A | 6/1995 | Teetzel | |
| 5,596,161 | A | 1/1997 | Sommers | |
| 5,679,916 | A | 10/1997 | Weichert | |
| 5,882,044 | A | 3/1999 | Sloane | |
| D415,813 | S | 10/1999 | O'Quinn et al. | |
| 6,079,311 | A | 6/2000 | O'Quinn et al. | |
| D435,623 | S | 12/2000 | Andrews, Jr. et al. | |
| 6,302,009 | B1 | 10/2001 | O'Quinn et al. | |
| 6,575,074 | B1 | 6/2003 | Gaddini | |
| 6,837,139 | B2 | 1/2005 | Meyers | |
| 6,948,415 | B2 | 9/2005 | Matthers et al. | |
| 7,156,424 | B2 | 1/2007 | McCord | |
| 7,237,467 | B1 | 7/2007 | Melton | |
| 7,302,774 | B2 | 12/2007 | Meyers | |
| 7,325,474 | B2 | 2/2008 | Yoshimura et al. | |
| 7,587,969 | B2 * | 9/2009 | Silvers | F41A 21/34 181/223 |
| 7,588,122 | B2 | 9/2009 | Brittingham | |
| 7,594,464 | B2 | 9/2009 | Dueck | |
| 7,661,349 | B1 | 2/2010 | Brittingham | |
| 7,743,693 | B1 | 6/2010 | Brittingham | |
| 7,856,914 | B2 | 12/2010 | Shults et al. | |
| 7,874,238 | B2 | 1/2011 | Silvers | |
| 7,891,282 | B1 | 2/2011 | DeGroat | |
| 7,905,170 | B1 | 3/2011 | Brittingham et al. | |
| 7,905,319 | B2 | 3/2011 | Sullivan | |
| 7,931,118 | B1 | 4/2011 | Cronhelm | |
| 7,987,944 | B1 | 8/2011 | Brittingham et al. | |
| 8,015,908 | B2 * | 9/2011 | Kline | F41A 21/30 181/223 |
| 8,091,462 | B2 | 1/2012 | Dueck et al. | |
| 8,100,224 | B1 | 1/2012 | Olson | |
| 8,162,100 | B2 | 4/2012 | Shults et al. | |
| 8,322,266 | B2 | 12/2012 | Presz, Jr. et al. | |
| 8,424,441 | B2 | 4/2013 | Brittingham et al. | |
| 8,439,155 | B2 | 5/2013 | Shults et al. | |
| 8,453,789 | B1 | 6/2013 | Honigmann et al. | |
| 8,490,535 | B1 | 7/2013 | Moore et al. | |
| 8,505,680 | B2 | 8/2013 | Dueck | |
| 8,516,941 | B1 | 8/2013 | Oliver | |
| 8,528,691 | B1 | 9/2013 | Carmichael et al. | |
| 8,555,765 | B2 | 10/2013 | Graham, II et al. | |
| 8,714,301 | B2 * | 5/2014 | Shults | F41A 21/30 181/223 |
| 8,794,376 | B2 | 8/2014 | Shults et al. | |
| 8,857,306 | B1 | 10/2014 | Edsall | |
| 8,950,546 | B2 | 2/2015 | Shults et al. | |
| 8,991,550 | B2 | 3/2015 | Coley | |
| 9,097,482 | B1 * | 8/2015 | Holden | F41A 21/30 |
| 9,102,010 | B2 * | 8/2015 | Wilson | B23K 26/345 |
| D742,987 | S | 11/2015 | Holden et al. | |
| D742,988 | S | 11/2015 | Holden et al. | |
| D742,989 | S | 11/2015 | Holden et al. | |
| 9,328,984 | B2 | 5/2016 | Shults et al. | |
| 9,410,761 | B2 * | 8/2016 | Morris | F41A 21/30 |
| 9,476,661 | B2 * | 10/2016 | Troy | F41A 21/30 |
| 2005/0126382 | A1 | 6/2005 | Yoshimura et al. | |
| 2006/0060076 | A1 | 3/2006 | Dueck et al. | |
| 2007/0095198 | A1 | 5/2007 | Dater et al. | |
| 2007/0107590 | A1 | 5/2007 | Silvers | |
| 2007/0266844 | A1 | 11/2007 | Dueck | |
| 2008/0148928 | A1 | 6/2008 | McClellan | |
| 2008/0271944 | A1 | 11/2008 | Brittingham | |
| 2009/0050403 | A1 | 2/2009 | Brittingham | |
| 2009/0178549 | A1 | 7/2009 | Meyers | |
| 2010/0126334 | A1 | 5/2010 | Shults et al. | |
| 2010/0139145 | A1 | 6/2010 | Brittingham | |
| 2010/0199834 | A1 | 8/2010 | Dueck et al. | |
| 2010/0313743 | A1 | 12/2010 | Dueck et al. | |
| 2011/0036233 | A1 | 2/2011 | DeGroat | |
| 2011/0061966 | A1 | 3/2011 | Brittingham | |
| 2011/0067950 | A1 | 3/2011 | Shults et al. | |
| 2011/0072958 | A1 | 3/2011 | Brittingham et al. | |
| 2011/0297477 | A1 | 12/2011 | Koumbis | |
| 2012/0152093 | A1 | 6/2012 | Koumbis | |
| 2012/0180624 | A1 | 7/2012 | Troy et al. | |
| 2014/0020977 | A1 | 1/2014 | Shults | |
| 2015/0226506 | A1 | 8/2015 | Shults et al. | |
| 2015/0253099 | A1 | 9/2015 | Shults | |
| 2016/0187093 | A1 * | 6/2016 | Barrett | F41A 21/30 89/14.4 |
| 2016/0209149 | A1 * | 7/2016 | Fischer | F41C 33/02 |
| 2017/0160035 | A1 * | 6/2017 | Piemme | F41A 21/30 |
| 2017/0191780 | A1 * | 7/2017 | Barrett | F41A 21/30 |

* cited by examiner

SMALL CALIBER SUPPRESSOR

CROSS REFERENCE TO RELATED APPLICATION

This application is based upon and claims priority to U.S. Provisional Application No. 62/216,420, filed Sep. 10, 2015 and hereby incorporated by reference.

FIELD OF THE INVENTION

This invention concerns sound suppressors for firearms.

BACKGROUND

Small caliber ammunition, such as .22 long rifle, is extremely popular for sporting use such as "plinking", competitive target shooting and target practice as well as gun handling practice. The small caliber rounds are popular because they are inexpensive and produce no significant recoil and thus lend themselves to prolonged practice periods wherein large numbers of rounds are expended.

However, when discharged, small caliber rounds can produce impulsive noise measured at greater than 160 dB. This is significantly greater than the OSHA standard of 140 dB (regarded as "hearing safe" for impulsive noise) and thus protection to avoid hearing loss is necessary for small calibers. Hearing protection, in the form of plugs, custom molded ear pieces and earmuffs are widely used, but are sometimes uncomfortable and less than effective. There is clearly a need to mitigate hearing loss when using small caliber ammunition while also increasing the comfort and hearing protection afforded the shooter.

SUMMARY

The invention concerns a baffle for a firearm sound suppressor. In one example embodiment the baffle comprises a plate having a geometric center. A truncated cone projects from the plate. The truncated cone defines an opening through the plate. The opening is positioned offset from the geometric center of the plate.

In a specific example the truncated cone is a right circular truncated cone. In another example the plate is flat. By way of further example the truncated cone comprises an inner surface surrounding an axis projecting transversely to the plate. A lip is positioned on the inner surface. The lip extends around and projects toward the axis. In a particular example embodiment the lip is positioned at an end of the truncated cone distal to the plate.

In an example embodiment the truncated cone comprises a sidewall. An aperture is positioned in the sidewall. By way of example, the aperture is contiguous with the opening. Another example baffle further comprises a skirt surrounding the plate and projecting transversely thereto. In a specific example the skirt projects from the plate in a direction opposite to the truncated cone.

The invention also encompasses a sound suppressor for a firearm. In one example embodiment the sound suppressor comprises a container having an entrance orifice and an exit orifice aligned with the entrance orifice and defining a firing axis. A plurality of baffles are arranged in spaced apart relation adjacent to one another within the container. At least one of the baffles comprises a plate oriented transversely to the firing axis. The plate has a geometric center. A truncated cone projects from the plate toward the entrance orifice. The truncated cone defines an opening through the plate aligned with the firing axis. The opening is positioned offset from the geometric center of the plate.

In a particular example embodiment the truncated cone is a right circular truncated cone. In a further example, the plate is flat. Again by way of example, the plate is oriented perpendicular to the firing axis. In an example embodiment the truncated cone comprises an inner surface surrounding the firing axis. A lip is positioned on the inner surface. The lip extends around and projects toward the firing axis. By way of example the lip is positioned at an end of the truncated cone distal to the plate.

In a specific example embodiment the truncated cone comprises a sidewall. An aperture is positioned in the sidewall. By way of example, the aperture is contiguous with the opening. An example embodiment further comprises a skirt surrounding the plate and projecting transversely thereto. The skirt forms at least a portion of the container in this example. In a specific example the skirt projects from the plate in a direction opposite to the truncated cone. The example sound suppressor embodiment includes it being mounted on a firearm.

By way of further example, the invention encompasses a sound suppressor for a firearm comprising a container formed of a plurality of segments attached to one another end to end. The plurality of segments include a first segment defining an entrance orifice, a last segment defining an exit orifice aligned with the entrance orifice and thereby defining a firing axis, and a plurality of baffle segments therebetween. By way of example each of the baffle segments comprises a plate oriented transversely to the firing axis. Each the plate has a geometric center. A skirt surrounds each plate and projects transversely thereto. Each the skirt forms at least a portion of the container. A truncated cone projects from each plate toward the entrance orifice. Each the truncated cone defines an opening through each the plate. Each opening is aligned with the firing axis. Each the opening is positioned offset from the geometric center of each the plate in this example embodiment.

In a specific example embodiment the skirts project from the plates in a direction opposite to the truncated cone. By way of further example the skirts on each of the baffle segments engage one another to form the container.

In a particular example embodiment the first segment comprises a plate surrounded by a skirt projecting transversely thereto. The last segment comprises a plate surrounded by a skirt projecting transversely thereto. The skirt of the first segment engages a skirt of one of the baffle plates and the skirt of the last segment engages a skirt of another one of the baffle plates to form the container. By way of further example a rod extends between the first and the last segments. The rod passes through and holds the baffle segments attached to one another end to end. In a particular example the rod is threadedly attached to the first and the last segments. In an example embodiment the first segment comprises means for attaching the sound suppressor to the firearm. In a specific example the means for attaching comprises an internally threaded collar.

In a specific example, each of the truncated cones is a right circular truncated cone. Further by way of example, each of the plates is flat. In another example, each of the plates is oriented perpendicularly to the firing axis. In an example embodiment, each of the truncated cones comprises an inner surface surrounding the firing axis. A lip is positioned on the inner surface of each of the truncated cones. Each of the lips extends around and projects toward the firing axis. In a specific example each of the lips is positioned at an end of each of the truncated cones distal to the plates on which the truncated cones are respectively mounted.

In a further example embodiment, each of the truncated cones comprises a sidewall. An aperture is positioned in each of the sidewalls. In a specific example, each of the apertures is contiguous with one of the openings in each of the truncated cones. The example invention also includes the sound suppressor mounted on a firearm.

The invention further comprises a kit for a sound suppressor for a firearm. In one example the kit comprises a plurality of segments attachable to one another end to end. The plurality of segments include a first segment defining an entrance orifice, a last segment defining an exit orifice aligned with the entrance orifice and thereby defining a firing axis, and a plurality of baffle segments positionable between the first and last segments. In an example embodiment each of the baffle segments comprises a plate oriented transversely to the firing axis. Each plate has a geometric center. A skirt surrounds each the plate and projects transversely thereto. Each skirt forms at least a portion of the container. A truncated cone projects from each the plate toward the entrance orifice. Each truncated cone defines an opening through each the plate. Each opening is aligned with the firing axis. In this example embodiment each the opening is positioned offset from the geometric center of each plate. The kit also includes a plurality of rods having different lengths from one another in an example embodiment. In this example any one of the rods is positionable between the first and the last segments. The rods pass between and hold the segments attached to one another end to end. By way of specific example the rods are threadedly attachable to the first and the last segments.

DETAILED DESCRIPTION

Figure 1:
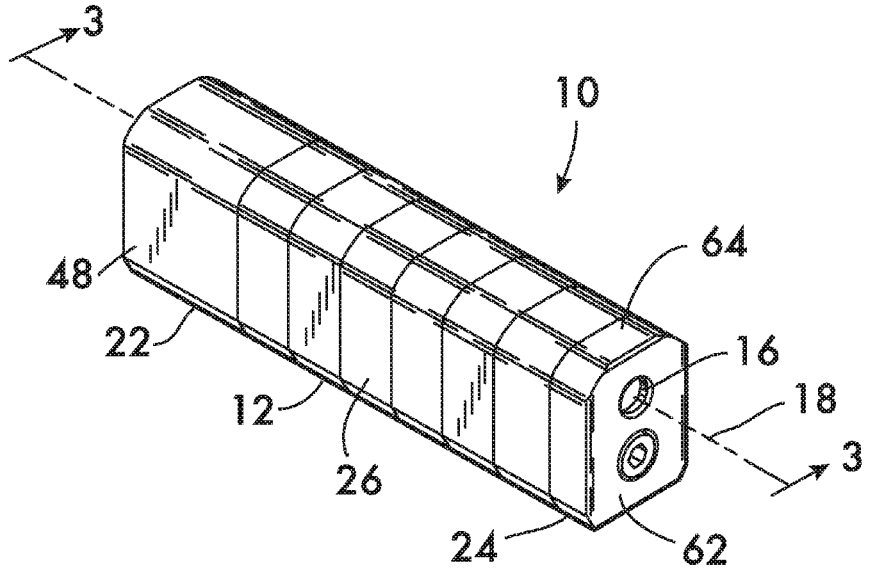
FIGS. 1 and 2 are isometric views of an example suppressor according to the invention.
Figure 2:
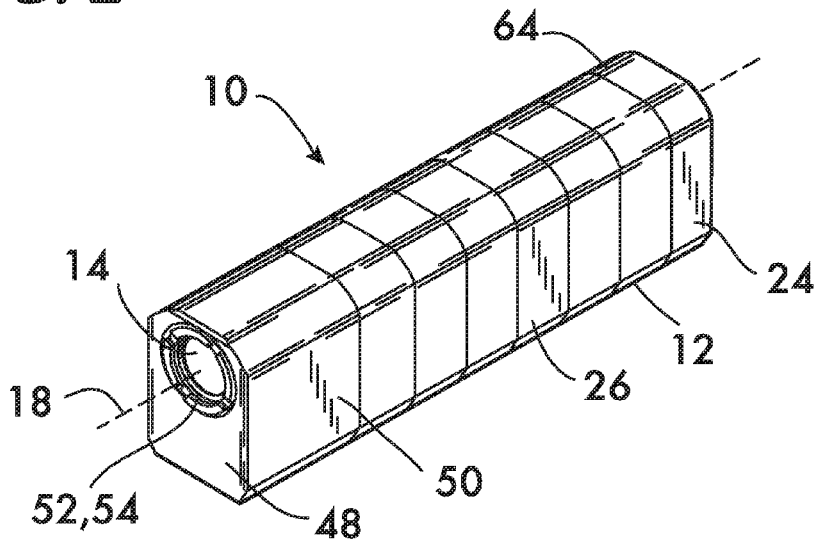

FIGS. 1 and 2 show an example suppressor 10 according to the invention. Suppressor 10 is advantageously used on small caliber firearms and comprises a container 12 having an entrance orifice 14 and an exit orifice 16. The entrance and exit orifices 14 and 16 are aligned with one another to define a firing axis 18 along which a projectile fired through the suppressor travels. As shown with further reference to FIG. 3, this example embodiment is formed of a plurality of segments 20 attached to one another end to end. Segments 20 include a first segment 22 defining the entrance orifice 14, a last segment 24 defining the exit orifice 16, and a plurality of baffle segments 26 positioned between the first and last segments 22 and 24.

Figure 3:
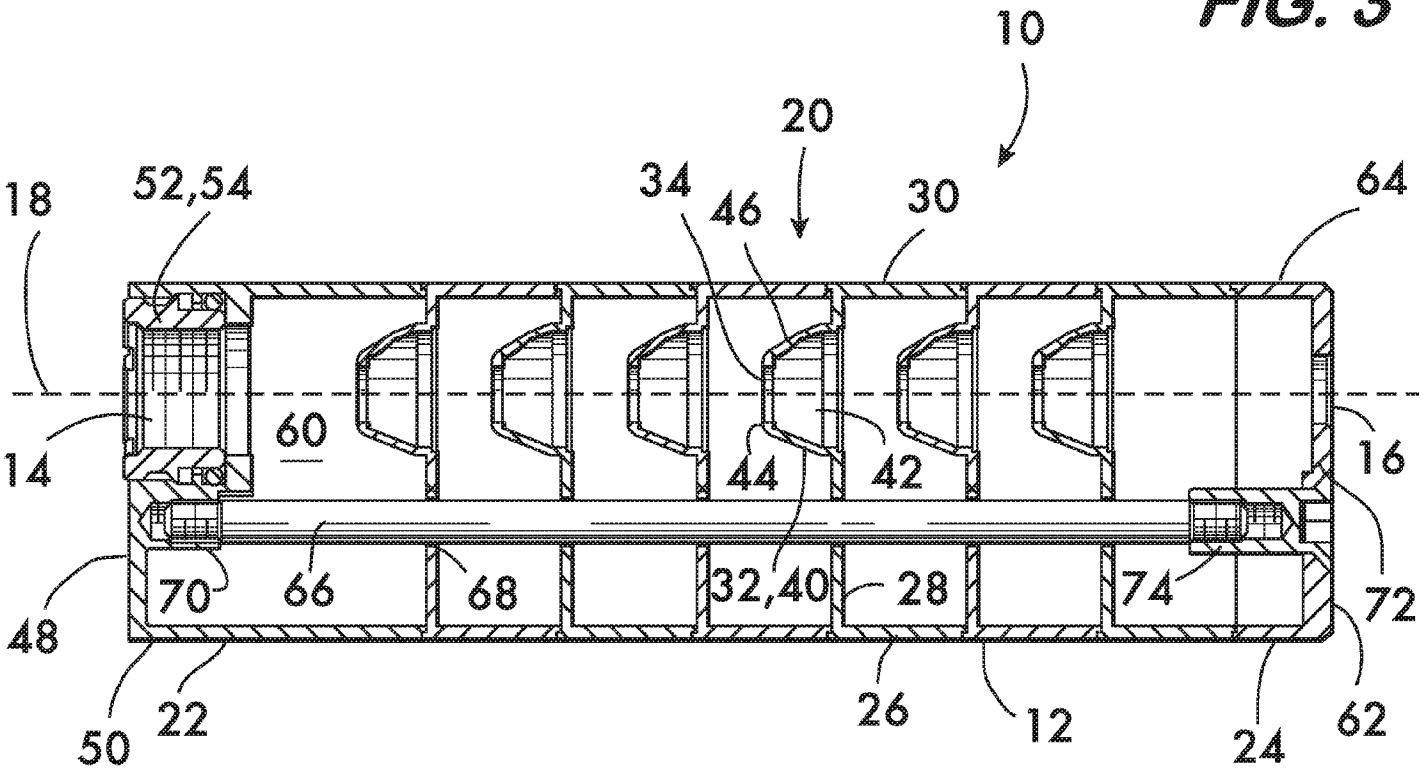
FIG. 3 is a longitudinal sectional view taken at line 3-3 of FIG. 1.
Figure 4:
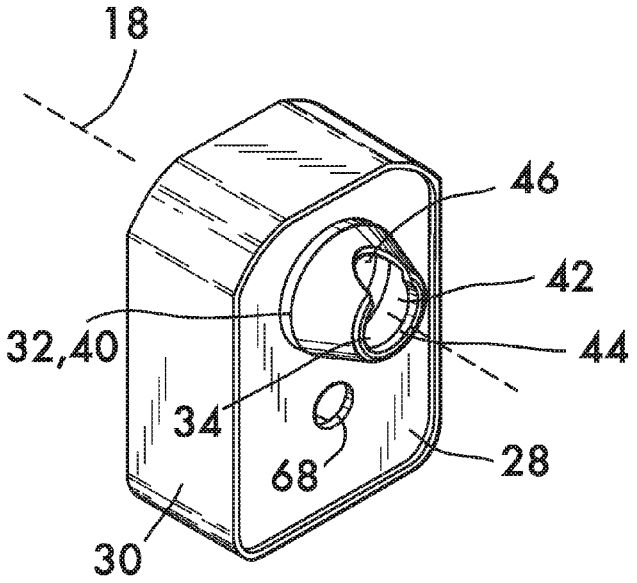
FIG. 4 is an isometric view of a baffle segment used in the suppressor of FIG. 1.

As shown in detail in FIGS. 3 and 4, at least one baffle segment 26 comprises a plate 28 oriented transversely to the firing axis 18. In this example embodiment the plate 28 is flat and oriented substantially perpendicular to the firing axis. A skirt 30 surrounds plate 28. For each baffle segment 26, the skirt 30 projects transversely to the plate 28 and the skirts combine to form a portion of the container 12 when the segments 26 are attached to one another end to end as shown in FIG. 3.

Figure 5:
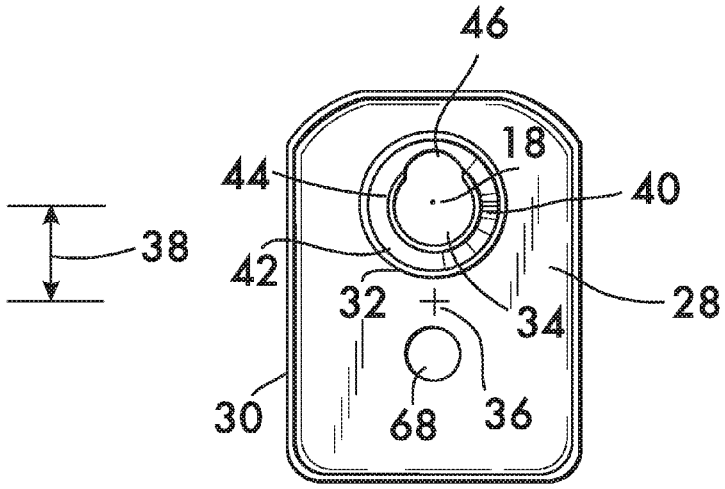
FIG. 5 is an inside view of the baffle segment shown in FIG. 4.

A truncated cone 32 projects from plate 28 of the baffle segment 26. In this example, cone 32 is a right circular truncated cone and defines an opening 34 through plate 28 which is aligned with the firing axis 18. As shown in FIG. 5, plate 28 has a geometric center 36. Opening 34 defined by cone 32 projecting from plate 28 is offset from the geometric center 36 by an offset distance 38. In the example baffle segment 26 the skirt 30 projects from plate 28 in a direction opposite to the truncated cone 32.

As shown in FIGS. 3, 4 and 5, cone 32 comprises a sidewall 40 with an inner surface 42 surrounding the firing axis 18. A lip 44 is positioned on the inner surface 42. Lip 44 extends around and projects toward the firing axis 18. In this example embodiment the lip 44 is positioned at an end of the cone 32 distal to plate 28. Lips 44 are believed to induce turbulence in the gas stream as it passes through openings 34 during discharge of a round, and thus increase energy dissipation within the gas and contribute to the reduction of noise upon firing. To further disrupt the gas flow through the openings 34 and dissipate acoustic energy of the gas stream an aperture 46 is positioned in the sidewall 40 of the cone 32. In this example embodiment the aperture 46 is contiguous with the opening 34 defined by the cone 32.

Figure 6:
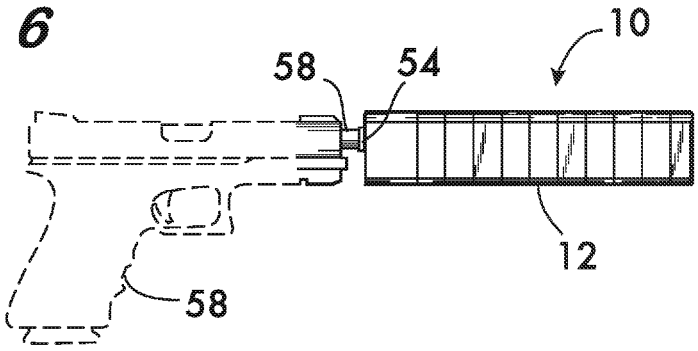
FIG. 6 is a side view of an example firearm with a suppressor according to the invention.

As shown in FIG. 3, first segment 22 which defines the entrance orifice 14 comprises a plate 48 surrounded by a skirt 50, the skirt projecting transversely to the plate. Entrance orifice 14 passes through the plate 48, which also houses a means 52 for attaching the suppressor 10 to a firearm. In the illustrated example of FIGS. 3 and 6 the attachment means 52 comprises an internally threaded collar 54 which engages an externally threaded portion of a barrel 56 of a firearm 58. Other attachment means are also feasible, for example, as disclosed in U.S. Pat. Nos. 8,162,100; 8,439,155; 8,950,546 and 8,714,301 and hereby incorporated by reference.

Figure 7:
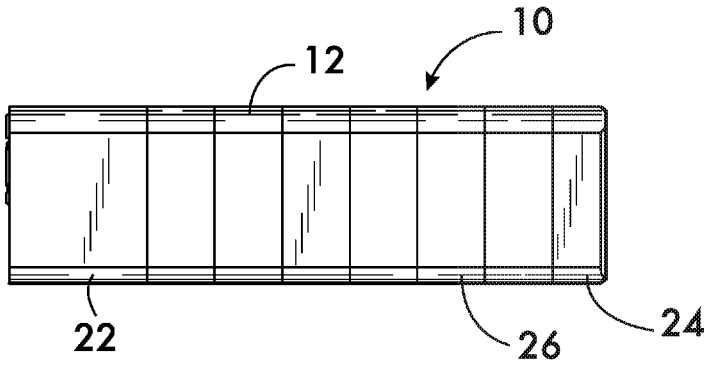
FIG. 7 is a side view of an example suppressor having six baffle segments.
Figure 8:
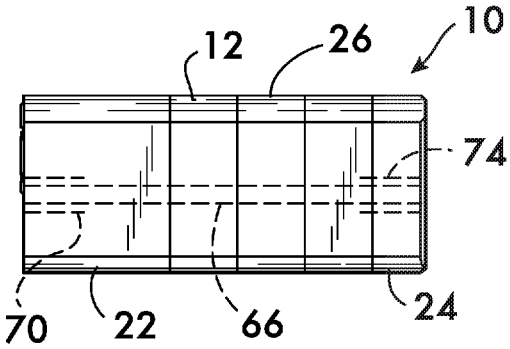
FIG. 8 is a side view of an example suppressor having three baffle segments.

As shown in FIG. 3, the skirt 50 of the first segment 22 is elongated as compared with the skirts 30 of the baffle segments 26 and forms an expansion chamber 60 within container 12 to provide for energy dissipation of the gas stream as it enters the container. Last segment 24, which defines the exit orifice 16 also comprises a plate 62 surrounded by a skirt 64, the skirt projecting transversely to the plate. Together the skirt 50 of the first segment 22 and skirt 64 of the last segment 24 engage skirts 30 of baffle segments 26 and form the container 12. In this example the first segment 22, baffle segments 26 and last segment 24 are held attached to one another end to end by a rod 66 that passes through a hole 68 in plates 28 of the baffle segments 26 (see also FIG. 4) and is threadedly engaged with the first and last segments. In the example shown in FIG. 3 a fitting 70 having internal threads is integrally formed with the first segment 22 to receive the rod 66. The last segment 24 has a countersunk opening 72 that receives an internally threaded socket nut 74 tightenable by a hex head driver (not shown). This configuration permits easy assembly of the container and allows the number of baffle segments 26 to be varied as shown in FIGS. 7 and 8. Different sized rods 66 are provided based upon the number of baffle segments 26 to be used.

Tests with .22 caliber rounds having a muzzle velocity of 1070 fps have shown that the suppressor 10 according to the invention having six baffle segments 26 arranged between the first and last segments 22 and 24 as shown in FIG. 7 achieved a measured sound level of 112 dB at a distance of 1 meter to the side of the muzzle, well below the 140 dB benchmark. Even with only three baffle segments 26, as shown in FIG. 8, the suppressor 10 achieved an impressive measured sound level of 127 dB, still significantly below the 140 dB standard.

The advantage of using threaded attachments between the baffle segments as well as the excellent noise reduction performance achieved with fewer than six baffle segments allows the suppressor according to the invention to be supplied as a kit, including a first and a last segment, a plurality of baffle segments and a plurality of rods of different length to allow a suppressor of different practical lengths to be assembled as desired by the shooter.

It is expected that suppressors 10 according to the invention will effectively reduce the sound level of discharge for firearms, both handguns and long guns, for small caliber ammunition of .22 caliber, as well as pistol ammunition including .25 ACP and up to .380 ACP.

What is claimed is:

1. A sound suppressor for a firearm, said sound suppressor comprising:

a container formed of a plurality of segments attached to one another end to end, said plurality of segments including a first segment defining an entrance orifice, a last segment defining an exit orifice aligned with said entrance orifice and thereby defining a firing axis, and a plurality of baffle segments therebetween, each of said baffle segments comprising:

a plate oriented transversely to said firing axis, each said plate having a geometric center;

a skirt surrounding each said plate and projecting transversely thereto, each said skirt forming at least a portion of said container;

a truncated cone projecting from each said plate toward said entrance orifice, each said truncated cone defining an opening through each said plate, each said opening being aligned with said firing axis; wherein each said opening is positioned offset from said geometric center of each said plate.

2. The sound suppressor according to claim 1, wherein said skirts project from said plates in a direction opposite to said truncated cone.

3. The sound suppressor according to claim 1, wherein said skirts on each of said baffle segments engage one another to form said container.

4. The sound suppressor according to claim 3, wherein said first segment comprises a plate surrounded by a skirt projecting transversely thereto, said last segment comprises a plate surrounded by a skirt projecting transversely thereto, and said skirt of said first segment engages a skirt of one of said baffle plates and said skirt of said last segment engages a skirt of another one of said baffle plates to form said container.

5. The sound suppressor according to claim 4, further comprising a rod extending between said first and said last segments, said rod passing through and holding said baffle segments attached to one another end to end.

6. The sound suppressor according to claim 5, wherein said rod is threadedly attached to said first and said last segments.

7. The sound suppressor according to claim 1, wherein said first segment comprises means for attaching said sound suppressor to said firearm.

8. The sound suppressor according to claim 7, wherein said means for attaching comprises an internally threaded collar.

9. The sound suppressor according to claim 1, wherein each of said truncated cones is a right circular truncated cone.

10. The sound suppressor according to claim 1, wherein each of said plates is flat.

11. The sound suppressor according to claim 1, wherein each of said plates is oriented perpendicularly to said firing axis.

12. The sound suppressor according to claim 1, wherein each of said truncated cones comprises an inner surface surrounding said firing axis, a lip being positioned on said inner surface of each of said truncated cones, each of said lips extending around and projecting toward said firing axis.

13. The sound suppressor according to claim 12, wherein each of said lips is positioned at an end of each of said truncated cones distal to said plates on which said truncated cones are respectively mounted.

14. The sound suppressor according to claim 1, wherein each of said truncated cones comprises a sidewall, an aperture being positioned in each of said sidewalls.

15. The sound suppressor according to claim 14, wherein each of said apertures is contiguous with one of said openings in each of said truncated cones.

16. The sound suppressor according to claim 1, wherein said sound suppressor is mounted on a firearm.

* * * * *